US009835150B2

(12) United States Patent
Schivalocchi

(10) Patent No.: US 9,835,150 B2
(45) Date of Patent: Dec. 5, 2017

(54) PISTON FOR COLD CHAMBER DIE-CASTING MACHINES

(75) Inventor: Chiara Schivalocchi, Lugano (CH)

(73) Assignee: CPR SUISSE S.A., Lugano (CH)

( * ) Notice: Subject to any disclaimer, the term of this patent is extended or adjusted under 35 U.S.C. 154(b) by 355 days.

(21) Appl. No.: 14/394,690

(22) PCT Filed: Apr. 20, 2012

(86) PCT No.: PCT/IB2012/052007

§ 371 (c)(1),
(2), (4) Date: Oct. 15, 2014

(87) PCT Pub. No.: WO2013/156824

PCT Pub. Date: Oct. 24, 2013

(65) Prior Publication Data

US 2015/0096439 A1 Apr. 9, 2015

(51) Int. Cl.

| | |
|---|---|
| ***F01B 31/08*** | (2006.01) |
| ***F04B 53/14*** | (2006.01) |
| ***B22D 17/20*** | (2006.01) |

(52) U.S. Cl.

CPC ..... *F04B 53/14* (2013.01); *B22D 17/203* (2013.01); *B22D 17/2038* (2013.01)

(58) Field of Classification Search

CPC ..... B22D 17/2038; B22D 17/203; F16J 1/08
USPC ..... 92/53
See application file for complete search history.

(56) References Cited

U.S. PATENT DOCUMENTS

| | | | |
|---|---|---|---|
| 2,485,526 | A | 10/1949 | Bennett |
| 5,233,912 | A | 8/1993 | Mueller |

FOREIGN PATENT DOCUMENTS

| | | | |
|---|---|---|---|
| DE | 10 80 739 | B | 4/1960 |
| EP | 0 645 205 | A1 | 3/1995 |
| EP | 2 007 536 | B1 | 12/2009 |
| JP | 9-070654 | A | 3/1997 |
| WO | WO 2009/125437 | A1 | 10/2009 |

OTHER PUBLICATIONS

International Search Report for corresponding International Patent Application No. PCT/IB2012/052007 dated Jan. 15, 2013.

*Primary Examiner* — Michael Leslie
*Assistant Examiner* — Daniel Collins
(74) *Attorney, Agent, or Firm* — Merchant & Gould P.C.

(57) ABSTRACT

A piston for cold chamber die-casting machines includes a piston body terminating at the front with a frontal surface pushing molten metal and at least one ring seat made around the body suitable to house a respective sealing ring. An annular distribution channel is made in an intermediate annular portion of the bottom surface of the ring seat, which communicates with the frontal surface of the piston through at least two communication holes made in the piston body for flow of molten metal into the distribution channel, under the ring. The communication holes are inclined in relation to the piston axis and have a through section which increases towards the distribution channel.

13 Claims, 9 Drawing Sheets

PISTON FOR COLD CHAMBER DIE-CASTING MACHINES

This application is a National Stage Application of PCT/IB2012/052007, filed 20 Apr. 2012, and which application is incorporated herein by reference. To the extent appropriate, a claim of priority is made to the above disclosed application.

BACKGROUND OF THE INVENTION

In cold chamber die-casting machines the use of injection pistons with a steel or copper body and at least one outer sealing ring fitting in a seat next to the piston head are known of.

An example of such pistons is described in U.S. Pat. No. 5,233,912.

In WO2009125437, in the name of the same applicant, a piston for cold chamber die-casting machines is described comprising a body terminating at the front with a frontal surface pressing the molten metal and at least one sealing ring mounted in a respective annular seat made around said body. At least part of the bottom surface of the seat is crossed by at least two channels which extend mainly in a longitudinal direction and which come out at the front in said frontal surface of the piston for an inflow of the molten metal under the ring.

Preferably, said channels extend from the frontal surface of the piston almost up to the median line of the seat of the ring, so as to bring the molten metal mainly towards the barycentre of the sealing ring 16.

In such a way, the metal flowing to the seat, solidifying, creates a continuous thickening which radially pushes the ring outwards, thus progressively recovering wear, adapting it to any deformation of the piston container and thus protecting the latter.

It has however been experimented that with the piston described above, the molten metal which penetrates the channels does reach a central zone of the ring seat, that is to say deposits mainly under the barycentre of the ring, but, in certain conditions of use, is not always successfully distributed in an even manner around the entire bottom surface of the ring. In other words, in some cases, the metal which comes out of a channel penetrating under the ring does not have sufficient thrust to continue to flow towards the adjacent channels, but tends to solidify only at the end of the channel which it came out of. Consequently, the radial thrust caused by the metal which has flowed under the ring is located mainly in some zones causing an uneven distortion of the ring. The recovering of wear is, as a result, uneven around the ring, and the perfect adaptation of the ring itself to the inner surface of the container, which the piston slides in, is not achieved.

In addition, such distortion of the ring in turn causes a counter-thrust or reaction on the solidified metal below it, which obstructs the flow of new molten metal below that already solidified.

To such purpose, it is to be noted that while in hot chamber die-casting machines the piston is always immersed in a bath of metal in a liquid state, in cold chamber applications, every time the piston is returned to a rearward position and the die opened, the cooling system leads to the formation of a metal riser in front of the frontal surface of the piston and, in the case of the piston described above, to the solidification of the metal which has found its way into the channels and under the ring. One of the difficulties of making a piston recovering wear for cold chamber die-casting such as that described above consists of the fact that if one wishes new metal to flow under the ring at each work cycle to progressively recover wear, then when opening the die to remove the casting the metal which has solidified in the channels must also remain attached to the metallic riser attached to the piece. It is clear that the objective of trapping the metal under the sealing ring, therefore in a rearward position of the frontal surface of the piston as evenly as possible along the circumference of the piston, contrasts with the need to remove the riser so as to liberate the inflow channels of the metal under the ring at each cycle.

For example, it has been seen in some cases, with the piston described above, that the metal which has solidified in the channels is not completely removed together with the metallic riser but remains inside such channels preventing a correct inflow of metal under the ring in the subsequent cycle.

As said, all these problems are not present in hot chamber die casting machines in that the metal which has found its way into any interstices or passages intentionally created or present in the piston, does not solidify.

SUMMARY OF THE INVENTION

The purpose of the present invention is therefore to propose a piston for cold chamber die-casting machines which makes it possible to overcome the aforesaid limitations of the pistons according to the state of the art.

Such purposes are achieved by a piston.

BRIEF DESCRIPTION OF THE DRAWINGS

Further features and advantages of the piston according to the present invention will be more evident from the following description made with reference to the attached drawings, by way of an indicative and non-limiting example, wherein.

DETAILED DESCRIPTION OF THE PREFERRED EMBODIMENT

Figures 1, 1A, 2, 2A:
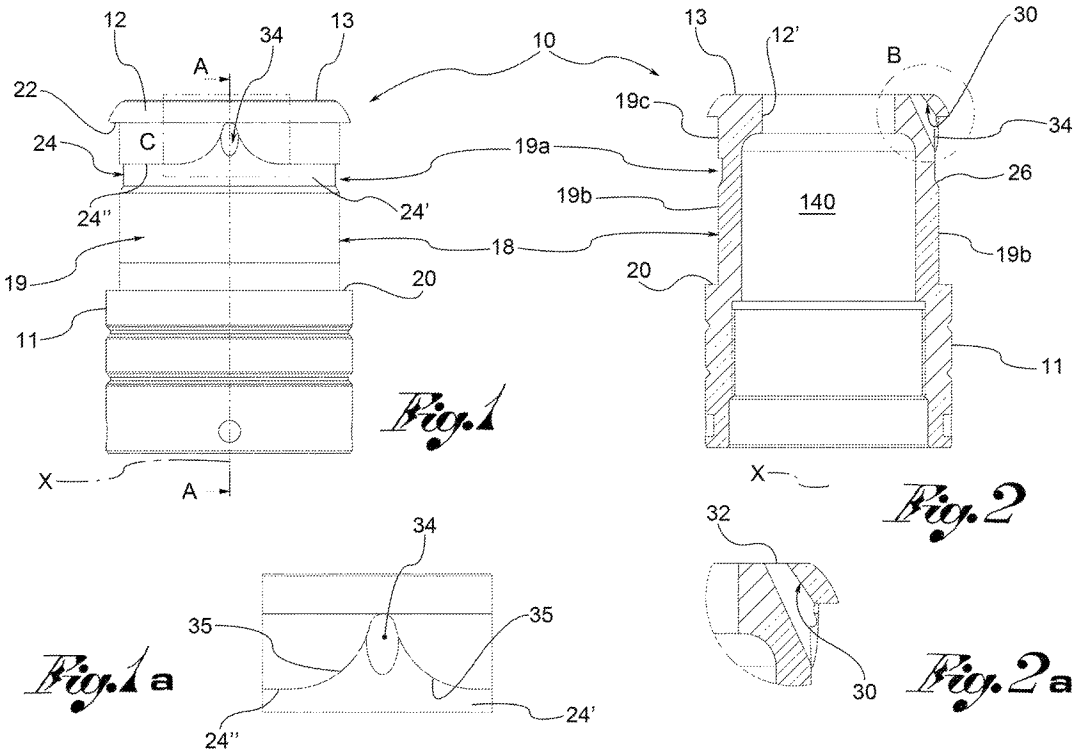
FIG. 1 is a elevated view of a piston according to the invention.
FIG. 1*a* is an enlarged view of the piston part in the box C in FIG. 1.
FIG. 2 is an axial cross section of the piston along the line A-A in FIG. 1.
FIG. 2*a* is an enlarged view of the piston part in the box B in FIG. 2.
Figure 1B:
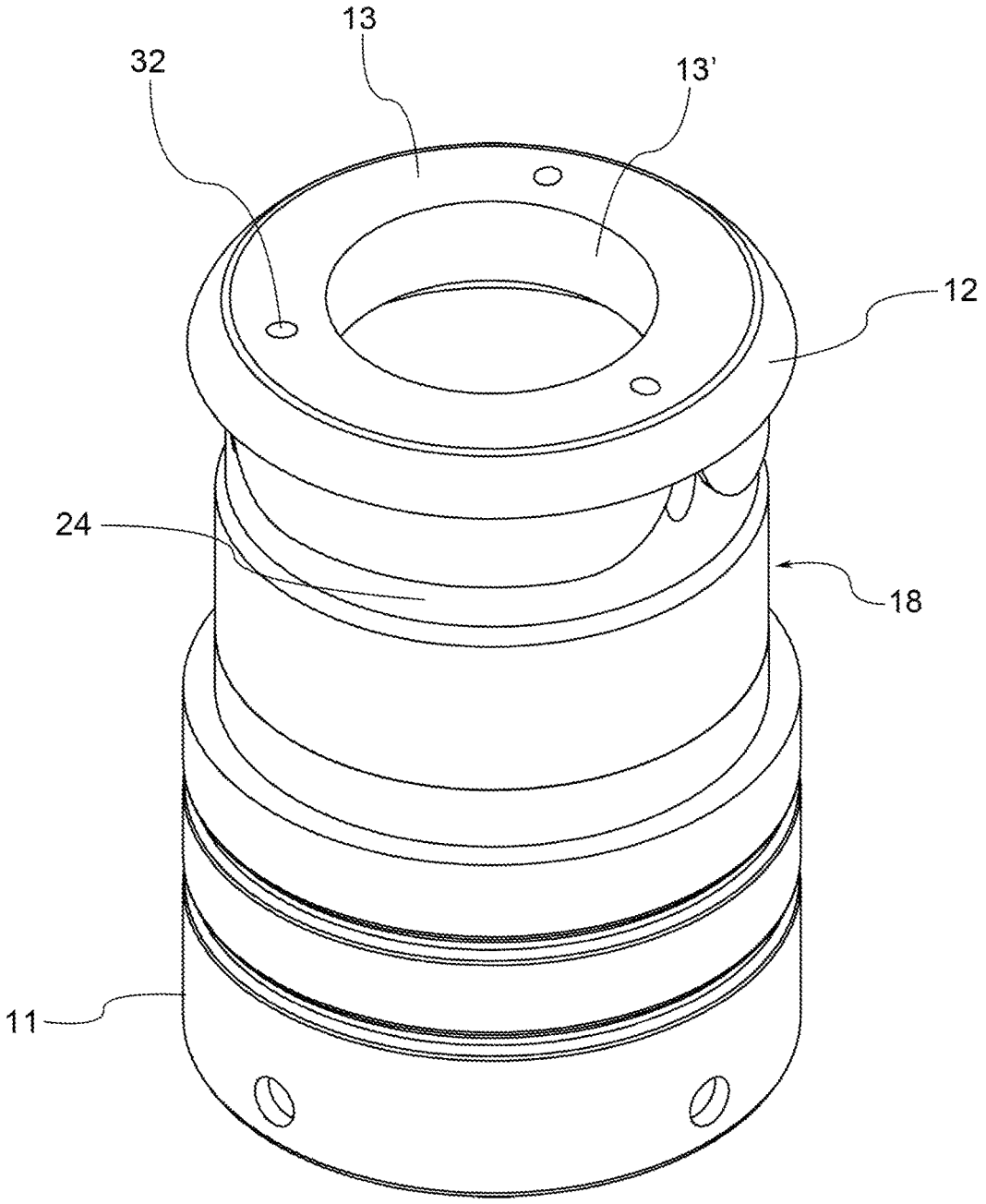
FIG. 1*b* is a perspective view of the piston.
Figure 3:
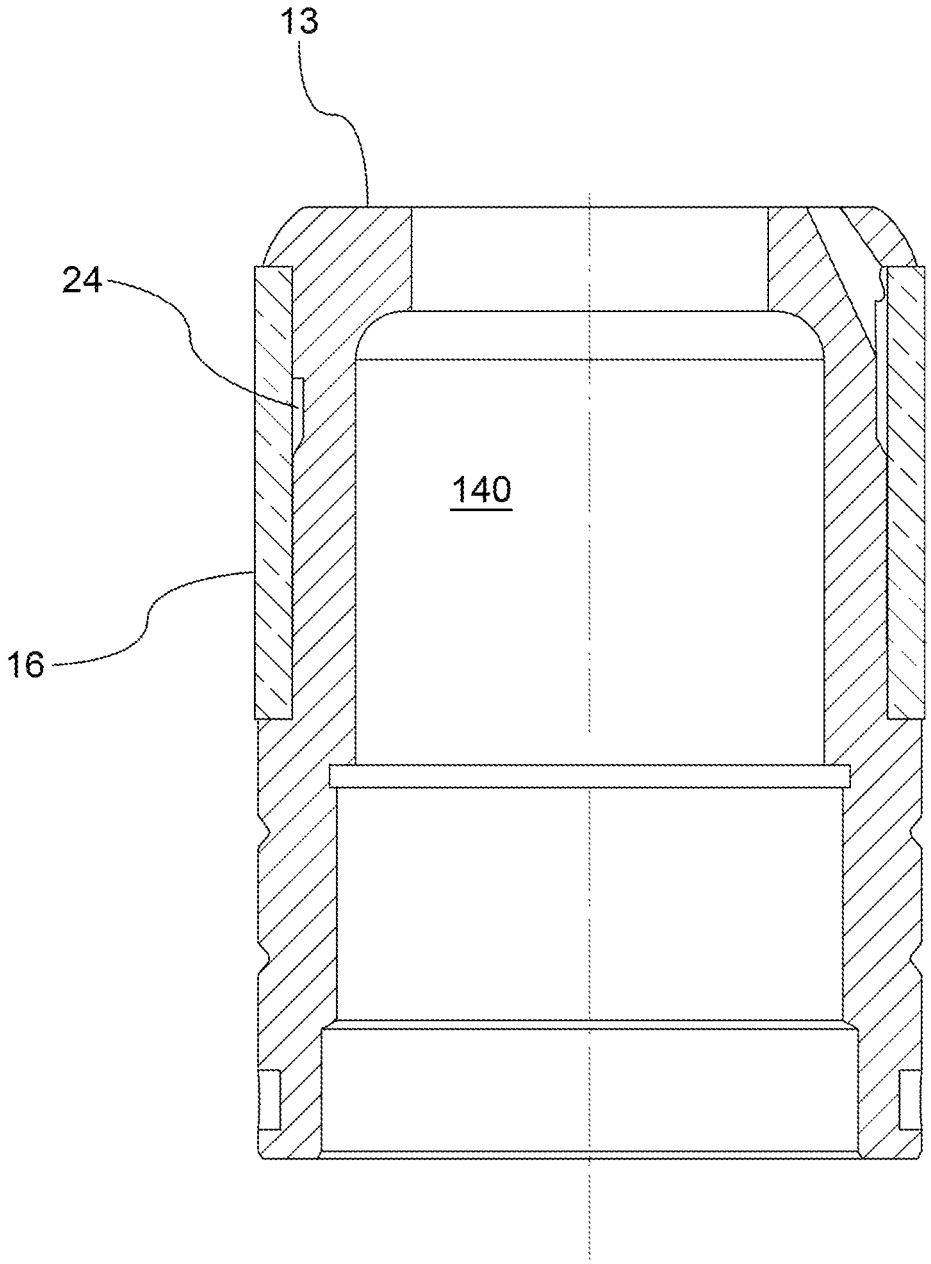
FIG. 3 is an axial cross-section of the piston with a sealing ring mounted next to the piston head.
Figure 4:
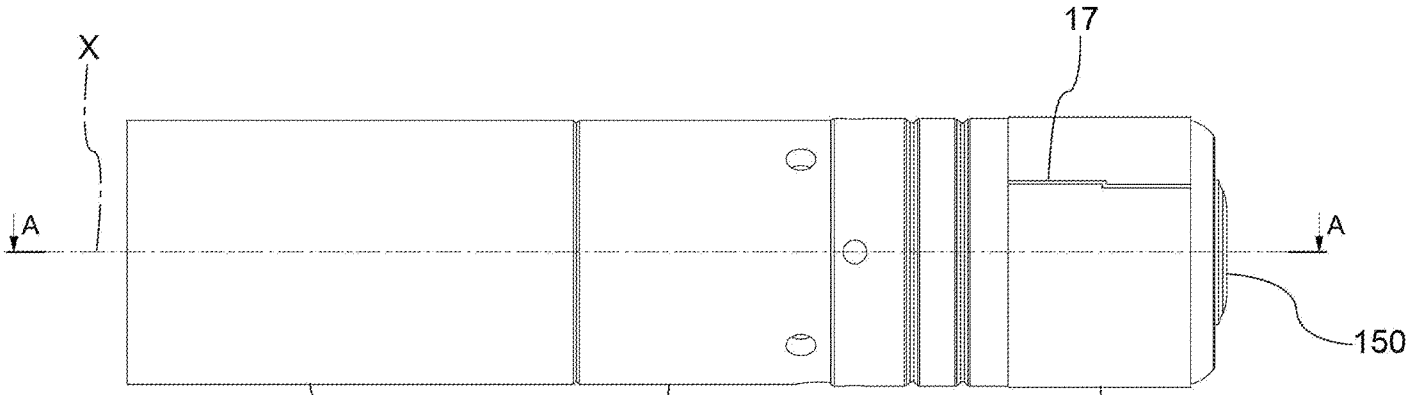
FIG. 4 shows the piston mounted on a stem.
Figure 5:
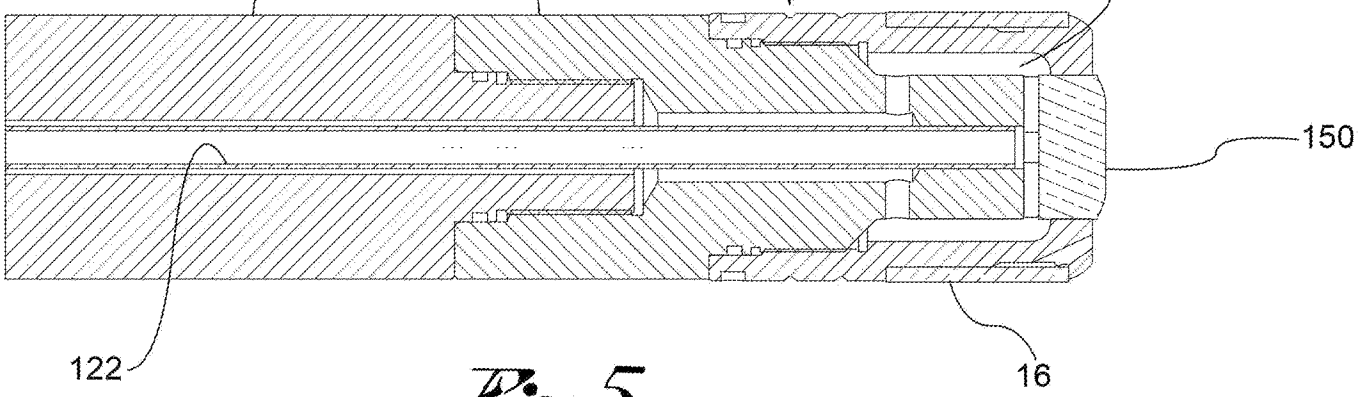
FIG. 5 is an axial cross section of the piston-stem assembly along the line A-A in FIG. 4.

With reference to the drawings, reference numeral 10 indicates a piston having a cylindrical body 11, preferably in steel. The body 11 terminates at the front, that is on the side pressing the molten metal, in a head 12. The head 12 is defined by a frontal surface 13 pressing the molten metal. Said frontal surface 13 may be flat or, as for example shown in FIGS. 8 and 9, convex, so as to facilitate the detachment of the metallic riser.

In a preferred embodiment, said body 11 is assembled, for example screwed on, to a stem 120. The stem 120 terminates at the front with a peg 121 coupling to the body 11, for example by screwing. Said peg 121 defines with the interior of said body 11, a cooling chamber 140. The stem 120 is crossed axially by a channel 122 able to transport a cooling liquid inside the chamber 140.

Advantageously, the head 12 of the piston 10 has an axial aperture 12', in which a copper pad 150 is inserted which helps to increase the cooling of said head 12, which is the part of the piston that overheats most during use.

On the front part of the body 11 of the piston, near the head 12, at least one sealing ring 16 is mounted, preferably in copper alloy.

The sealing ring 16 is housed in a respective ring seat 18, having an annular extension, made around the body 11. The seat 18 comprises a cylindrical bottom surface 19.

In a preferred embodiment, the ring seat 18 is defined rearwards by a rear annular abutment shoulder 20 made on the body 11 of the piston. Even more preferably, the ring seat 18 is made in a position rearward of the frontal surface 13 of the body 11 of the piston and is defined by a rear shoulder 20 and by a front shoulder 22 made in said body 11. In other words, the bottom surface of the ring seat 18 is lowered in relation to the outer cylindrical surface of the piston 10. In this preferred embodiment the head of the piston 12 is the front portion of the piston extending between the frontal surface 13 and the front shoulder 22.

As will be explained below however, there is nothing to prevent the ring seat 18 from extending frontwards as far as coming level with the frontal surface 13 of the piston; in this case, the piston head 12 practically coinciding with said frontal surface 13.

In a preferred embodiment, the sealing ring 16 is of the type with a longitudinal split 17, preferably step-shaped, so as to flexibly widen during fitting to the body 11 and, during use, when pressed radially by the molten metal which has flowed under it. The step shape of the longitudinal split 17 also prevents the transit of the molten metal through such split, enabling an optimal pressure seal.

A distribution channel 24 is made in an intermediate annular portion 19*a* of the bottom surface 19 of the ring seat 18. Said distribution channel 24 has an annular extension, that is, extends coaxially to the piston axis X. In other words, said distribution channel identifies a bottom surface 24' of the channel lowered further than the bottom surface 19 of the ring seat 18.

Consequently, the bottom surface 19 of the ring seat 18 comprises a rear annular portion 19*b* for supporting a corresponding rear portion of the sealing ring 16, said intermediate annular portion 19*a*, which the distribution channel 24 is made in, and a front annular portion 19*c* for supporting a corresponding front portion of the sealing ring 16.

Preferably, the rear annular portion 19*b* has a greater axial extension than the front annular portion 19*c*. Preferably, in addition, the distribution channel 24 has a lesser axial width than the rear 19*b* and front 19*c* annular portions of the bottom surface 19 of the ring seat 18.

Moreover, in a preferred embodiment, the distribution channel 24 is equal or inferior in depth to the ring seat 18, that is, in relation to the depth of the rear 19*b* and front 19*c* annular portions in relation to the outer cylindrical surface of the piston.

Furthermore, in a preferred embodiment, the distribution channel 24 is connected to the rear annular portion 19*b* of the bottom surface 19 of the ring seat 18 by means of a conical connection surface 26, for example having an inclination of approximately 30°. Advantageously, as will be described further below, said conical connection surface 26 terminates substantially midway of the axial width of the ring seat 18, that is substantially below the median line of the sealing ring 16.

Figure 7:
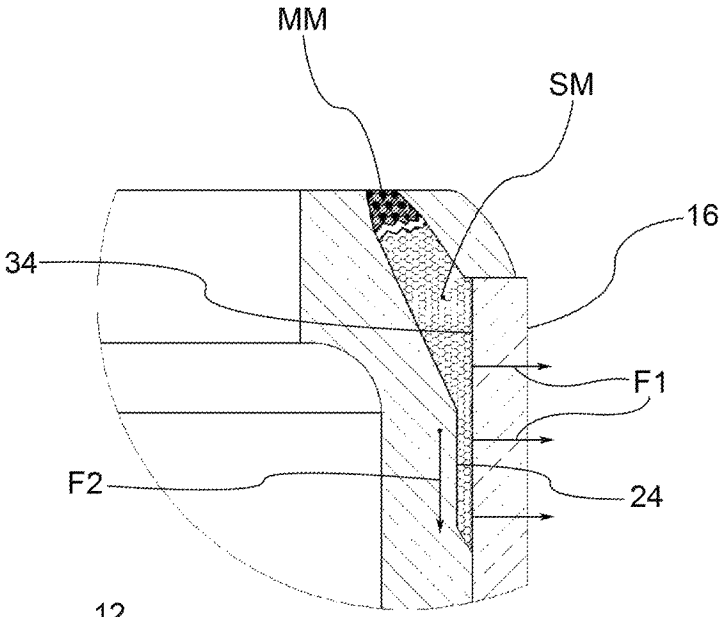
FIG. 7 shows the same enlarged view as FIG. 6*a* during a subsequent cycle.
Figure 6A:
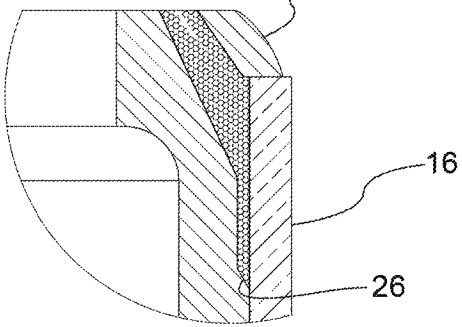
FIG. 6*a* is an enlarged view of the piston part in the detail B in FIG. 6.
Figure 6:
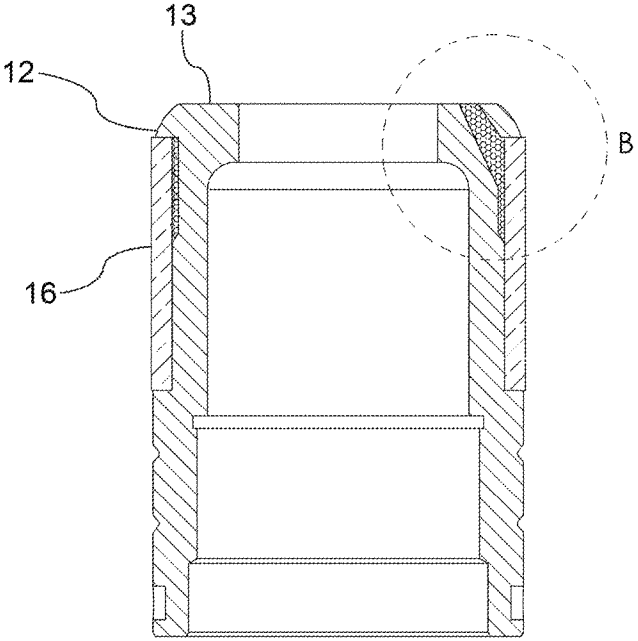
FIG. 6 shows the piston at the end of a working cycle, with metal solidified under the sealing ring in axial cross-section.

The distribution channel 24 communicates with the frontal surface 13 of the piston through at least two communication holes 30 made in the piston body 11. In one embodiment shown in FIGS. 1-7, there are three of said communication holes 30, angularly equidistant from each other. Such communication holes 30 permit a flow of molten metal into the distribution channel 24, and therefore under the ring 16, to achieve the recovering effect of the wear of the ring through the formation of successive annular layers of metal which solidify under the ring 16. Such layers of solidified metal radially push the ring outwards, recovering the thinning (FIG. 7).

Unlike the piston channels described above with reference to the prior art, which were radially open outwards, said communication holes 30 are made entirely inside the piston body 11, between an inlet aperture 32 of the molten metal, made in the frontal surface 13 of the piston, and an outlet aperture 34 of the molten metal, made in or facing the distribution channel 24.

The communication holes 30 are inclined in relation to the piston axis X. In other words, the axes of the inlet apertures 32 are distributed along a circumference coaxial to the piston axis X, said circumference having a smaller diameter than the circumference around which the outlet apertures 34 of said communication holes are made. For example, the communication holes 30 form an angle of about 30° with the piston axis X. For example, the inlet apertures 32 are made in the circular crown portion of the frontal surface 13 which surrounds the axial aperture 13'.

In addition, said communication holes 30 have a through section which increases towards the distribution channel 24, that is are a conical shape. For example, the solid angle identified by the communication holes 30 is about 10°.

According to a preferred embodiment, the outlet apertures 34 of the communication holes 30 are made in the front annular portion 19*c* of the bottom surface 19 and are open towards the annular distribution channel 24. Said front annular portion 19*c* is therefore interrupted by the outlet apertures 34 of the communication holes 30.

More in detail, each outlet aperture 34 is connected to the distribution channel 24 by arched connection walls diverging towards said channel 24. In a preferred embodiment, said connection walls 35 are a portion of the same front lateral wall 24" which defines the distribution channel 24 at the front in relation to the front annular portion 19*c* of the bottom surface 19 of the ring seat 18. In other words, the front lateral wall 24" of the distribution channel 24 forms, at each outlet aperture 34, a recess in the lower annular portion 19*c* of the bottom surface 19 of the ring seat 18, for example cusp-shaped, as shown for example in FIG. 1*a*. In such a way, each outlet aperture 34 comes out on an outlet surface coplanar with the bottom surface 24' of the distribution channel 24, but made in the front annular portion 19*c* of the bottom surface 19 of the ring seat 18.

Figure 8:
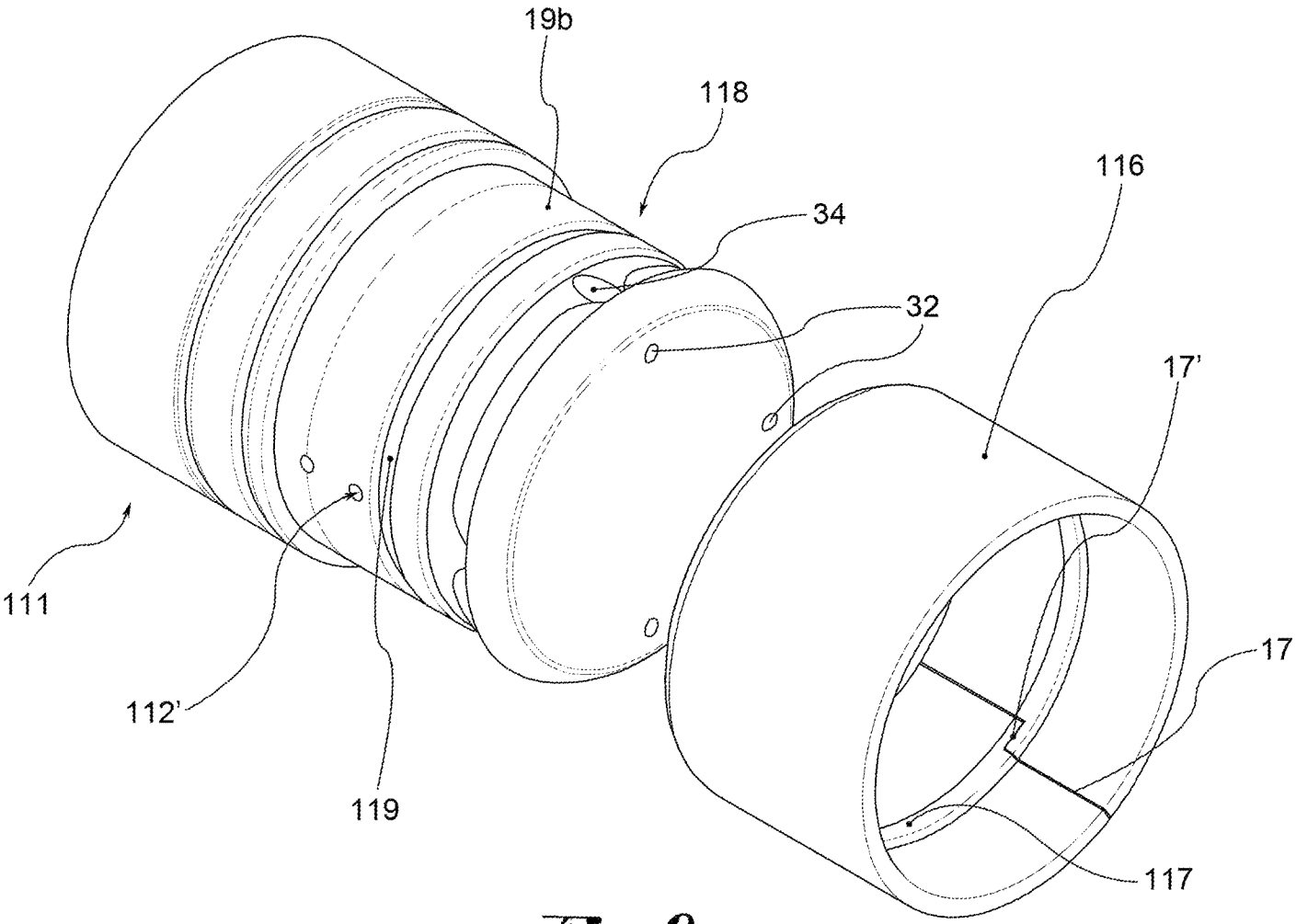
FIGS. 8 and 9 respectively show in exploded perspective and in axial cross-section, a piston according to the invention with sealing ring in one embodiment variation.
Figure 9:
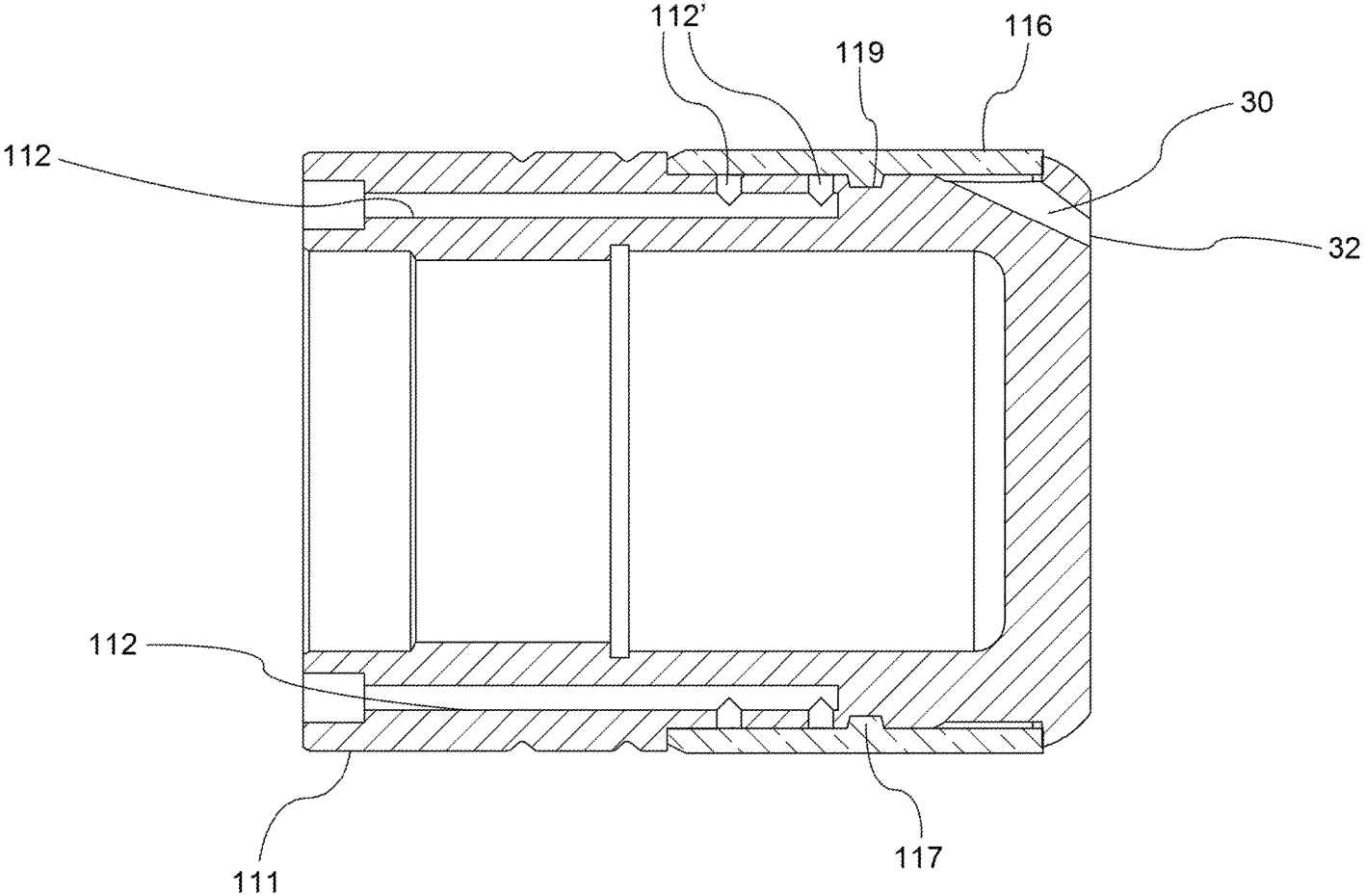
Figure 11:
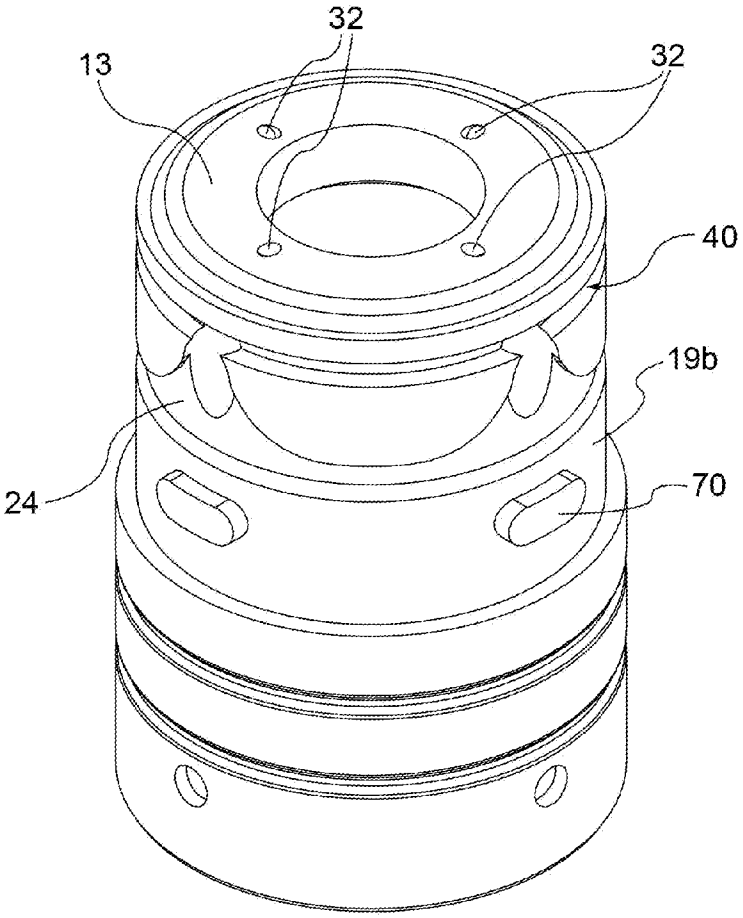
FIGS. 10 and 11 show perspective and elevated views of a piston according to the invention in a further embodiment variation.
Figure 10:
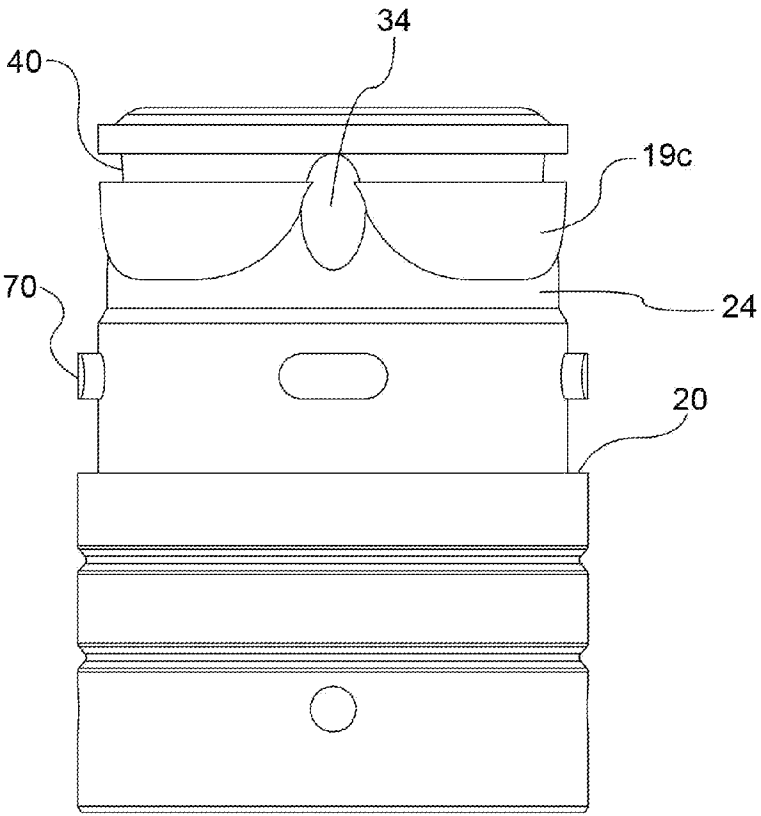
Figure 13:
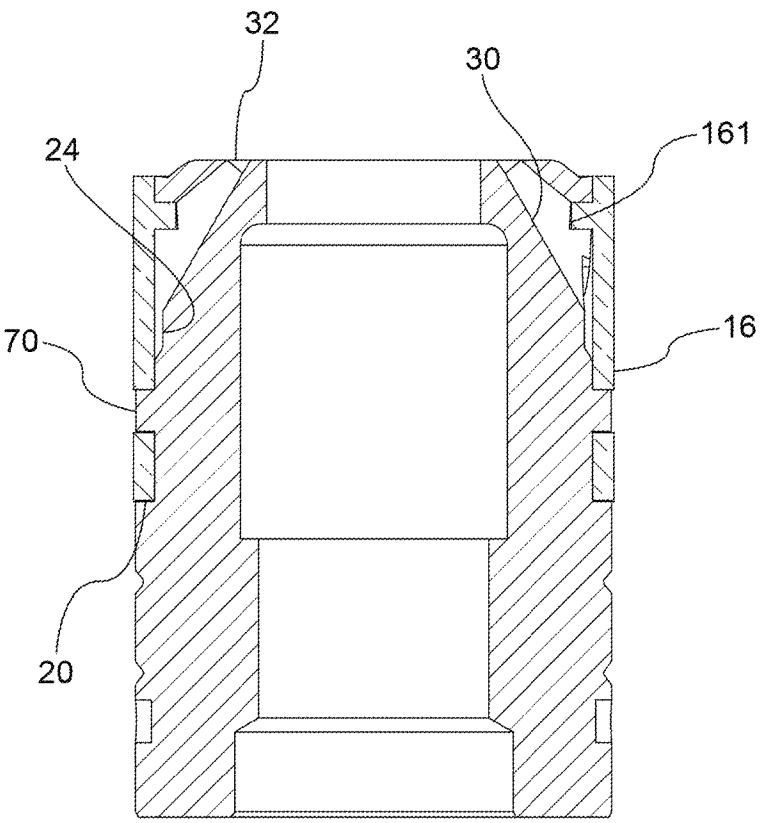
FIG. 13 is an axial cross section of the piston in the previous figure, along the line A-A in FIG. 10.
Figure 12:
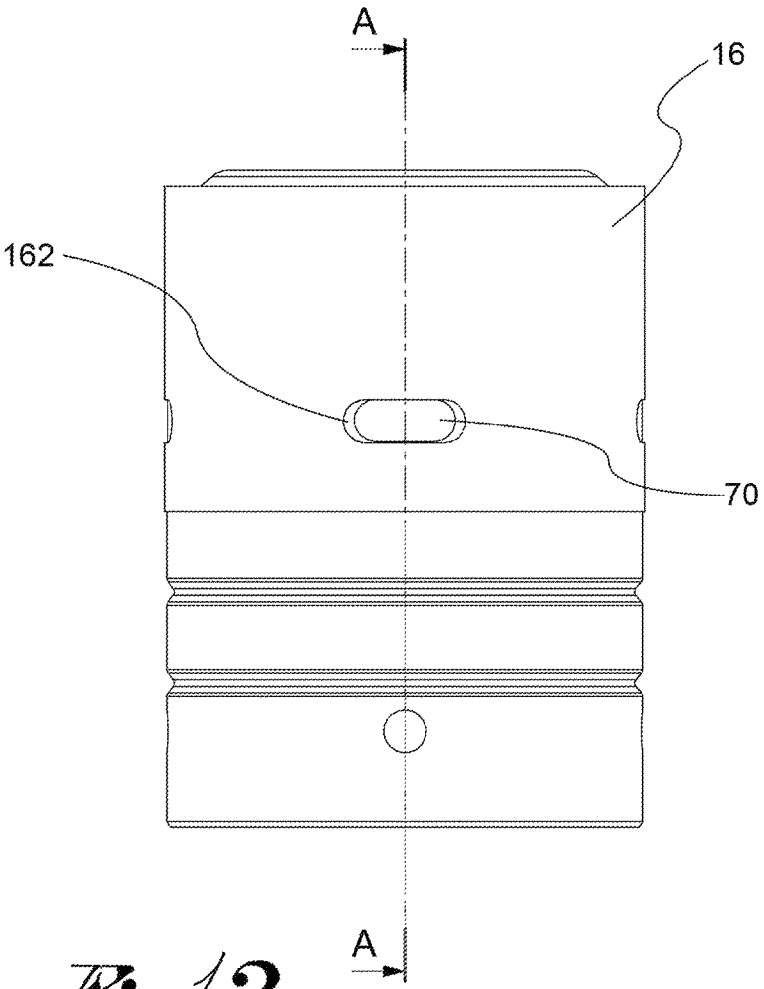
FIG. 12 is an elevated view of the piston in FIGS. 10 and 11, fitted with a sealing ring.

In one embodiment variation of the piston shown in FIGS. 8 and 9, particularly suitable for vacuum presses, the body 111 of the piston is provided with a lubrication circuit 112 coming out under the sealing ring 116, for example at the rear portion 19*b* of the ring seat 118. In a preferred embodiment, the sealing ring 116 is fitted with an inner circular tooth 117 which couples geometrically with a corresponding annular groove 119 made in the ring seat 118. Preferably said annular groove 119 is made distally to the exit holes 112' of the lubrication circuit 112 coming out under the sealing ring. For example said annular groove 119 is made axially between said exit holes 112' and the outlet apertures 34, in an intermediate position of the ring seat. The coupling between the tooth 117 of the ring and the annular groove 119 improves the seal between the ring and the outer surface of the piston, obstructing the passage of air between them.

Preferably, in addition, in the sealing ring 116 according to this embodiment, the transversal section 17' of the split 17, which identifies the step in said split 17 that is, is made along a portion of the tooth of the ring, that is where the thickness of the ring is greater. This makes it possible to avail of the greatest thickness possible between the facing transversal surfaces of the split 17, to the advantage of an improved seal of the ring.

In one embodiment variation of the piston shown in FIGS. 10-13, the ring seat 18 is not made in a rearward position and embedded in the piston, but terminates at the front next to or flush with the frontal surface 13 of the piston. Said ring seat 18 is therefore defined only by the rear shoulder 20. In addition, near the front end of the ring seat 18, an annular groove 40 is made in the ring seat 18. Said annular groove 40 in other words crosses the front portion 19*c* of the bottom wall 19 of the ring seat 18. More specifically, said annular groove 40 is tangent to the front end of the outlet apertures 34. The sealing ring 16 is provided with an internal annular projection 161 suitable for inserting in said annular groove by means of a shaped coupling.

As well as acting as an axial blocking element of the sealing ring, said internal annular projection 161 forms an obstacle to the liquid metal penetrating the communication holes 30 and forces said liquid metal to direct itself mainly towards the rear zone of the outlet apertures 34, and therefore towards the distribution channel 24.

It is to be noted that, in the embodiment shown in FIGS. 8-11, piston and sealing ring are also provided with anti-rotation means suitable to prevent a rotation of the sealing ring 16 on the piston. For example, said anti-rotation means are in the form of radial projections 70 which extend from the bottom wall 19 of the ring seat so as to engage corresponding apertures 162 made in the ring. Clearly, said anti-rotation means may also be provided on the piston in the first embodiment described.

Consequently, the metal in the molten state pushed by the frontal surface 13 of the piston penetrates the communication holes 30 and, by a rectilinear path, reaches the distribution channel 24. Such channel not being engaged by the sealing ring 16, which rests rather on the rear 19*b* and front 19*c* annular portions of the bottom surface 19 of the ring seat 18, the metal still in the liquid state is free to expand circumferentially in the distribution channel 2, that is, is free to evenly occupy the entire annular extension of said channel 24.

Such even distribution of the metal in the distribution channel 24 is favoured by the radial and divergent connection walls 35 which surround the outlet apertures 34 of the communication holes 30.

The inclined and conically shaped communication holes 30 made in the piston body are suitable to cause the breakage of the metallic riser at the inlet apertures 32. Unlike the longitudinal channel piston described above with reference to the prior art, in which the objective was for the metal solidifying in the channels to be completely extracted with the riser, with the piston according to the present invention the metal is left inside the communication holes 30, forming a sort of plug. Thanks to the conical shape of the communication channels in fact, when the liquid metal is pushed by the frontal surface of the piston, said plug is heated so as to amalgamate with the liquid metal acting on the frontal surface of the piston and is pushed into the distribution channel. In other terms, the communication holes 30 are made in such a way as to favour a sort of extrusion process by means of which the metal in the liquid state MM (in FIG. 7) which enters the inlet apertures 32 pushes the previously solidified metal SM into the communication holes 30 detaching it from the walls which define said holes 30 and making it enter the distribution channel 24, where it cools and solidifies (FIG. 7). In other words, at each casting cycle, when new metal in a liquid state penetrates the communication holes 30, thanks to the conical shape of said holes and the radial and divergent walls 35, a sort of remodelling of the deposit of metal under the sealing ring takes place, with the result that any interstice below the sealing ring is occupied by solidified metal and the sealing ring is pushed radially outward in a uniform manner. It is to be noted that the conical shape of the communication holes 30 prevents a return of the metal towards the piston head through the communication holes 30 during such phenomenon of amalgamation and remodelling of the metal under the ring.

When the solidified metal SM has filled said channel 24, thereby forming a ring under the sealing ring 16, the new metal MM coming from the communication holes tends to push said ring of metal not only in a radial direction (arrows F1 in FIG. 7) but also in an axial direction (arrow F2 in FIG. 7). Thanks to the presence of the conical connection surface 26 between the bottom surface 24' of the distribution channel 24 and the rear annular portion 19*b* of the bottom surface 19 of the ring seat 18, the metal ring in the distribution channel 24 forms rearwards a sort of wedge which, as a result of said axial thrust of the new metal coming from the communication holes, tends to cause the sealing ring 16 to rise in the desired point, in other words at its barycentre.

Consequently, the piston according to the present invention makes it possible to recover wear of the sealing ring in a safe, reliable and efficient manner.

Obviously, a person skilled in the art may make further modifications and variations to the piston according to the present invention so as to satisfy contingent and specific requirements, while remaining within the scope of protection of the invention as defined by the following claims.

The invention claimed is:

1. A piston for cold chamber die-casting machines, comprising:

a piston body terminating at the front with a frontal surface pushing molten metal and at least one ring seat made around said body suitable to house a respective sealing ring, wherein said ring seat comprises a bottom surface;

an annular distribution channel formed in an intermediate annular portion of said bottom surface;

wherein said annular distribution channel communicates with said frontal surface of the piston through at least two communication holes made in the piston body for flow of molten metal into the distribution channel under the ring, said communication holes being inclined in relation to a piston axis and having a through section which increases towards the distribution channel;

wherein said bottom surface comprises a rear annular support portion for supporting a corresponding rear portion of the sealing ring, the intermediate annular portion and a front annular support portion for supporting a corresponding front portion of the sealing ring.

2. The piston according to claim 1, wherein said front annular portion of the bottom surface is interrupted by outlet apertures of the communication holes, said outlet apertures being open towards the annular distribution channel.

3. The piston according to claim 2, wherein each of the outlet apertures is connected to the distribution channel by arched connection walls diverging towards said channel.

4. The piston according to claim 1, wherein the distribution channel is equal or inferior in depth to a depth of the annular seat of the ring.

5. The piston according to claim 1, wherein the communication holes emerge on the frontal surface of the piston with inlet apertures distributed along a circumference coaxial to the piston axis, said circumference having a smaller diameter than a circumference around which the outlet apertures of said communication holes are made.

6. The piston according to claim 1, wherein the annular ring seat is delimited rearwards by an annular abutment shoulder made on the body of the piston.

7. The piston according to claim 1, further comprising anti-rotation means for cooperating with corresponding anti-rotation means made on the ring to prevent rotation of the sealing ring on the piston.

8. The piston according to claim 7, wherein said anti-rotation means comprise radial projections extending from the bottom wall of the ring seat to engage corresponding apertures made in the ring.

9. A piston for cold chamber die-casting machines, comprising:

a piston body terminating at the front with a frontal surface pushing molten metal and at least one ring seat made around said body suitable to house a respective sealing ring, wherein said ring seat comprises a bottom surface;

an annular distribution channel formed in an intermediate annular portion of said bottom surface;

wherein said annular distribution channel communicates with said frontal surface of the piston through at least two communication holes made in the piston body for flow of molten metal into the distribution channel under the ring, said communication holes being inclined in relation to a piston axis and having a through section which increases towards the distribution channel;

wherein the distribution channel is connected to the rear annular portion of the bottom surface of the annular seat by a conical connection surface.

10. A piston for cold chamber die-casting machines, comprising:

a piston body terminating at the front with a frontal surface pushing molten metal and at least one ring seat made around said body suitable to house a respective sealing ring, wherein said ring seat comprises a bottom surface;

an annular distribution channel formed in an intermediate annular portion of said bottom surface;

wherein said annular distribution channel communicates with said frontal surface of the piston through at least two communication holes made in the piston body for flow of molten metal into the distribution channel under the ring, said communication holes being inclined in relation to a piston axis and having a through section which increases towards the distribution channel;

wherein the ring seat is at a position rearward of the frontal surface of the body of the piston and is defined by a rear shoulder and by a front shoulder made in said body.

11. A piston for cold chamber die-casting machines, comprising:

a piston body terminating at the front with a frontal surface pushing molten metal and at least one ring seat made around said body suitable to house a respective sealing ring, wherein said ring seat comprises a bottom surface;

an annular distribution channel formed in an intermediate annular portion of said bottom surface;

wherein said annular distribution channel communicates with said frontal surface of the piston through at least two communication holes made in the piston body for flow of molten metal into the distribution channel under the ring, said communication holes being inclined in relation to a piston axis and having a through section which increases towards the distribution channel;

wherein the ring seat terminates at the front next to the frontal surface of the piston; the piston and ring being provided with an axial block suitable to prevent an axial translation of the ring in relation to the piston.

12. The piston according to claim 11, wherein an annular groove is made in the ring seat suitable to receive a corresponding internal annular projection made in the ring by a shaped coupling.

13. Piston according to claim 12, wherein said annular groove is internally tangent to a front end of the outlet aperture of the communication holes.

* * * * *